US005845767A

United States Patent [19]

Suzuki

[11] Patent Number: 5,845,767

[45] Date of Patent: Dec. 8, 1998

[54] STOPPER STRUCTURE FOR A SWITCH

[75] Inventor: Hiroshi Suzuki, Tokyo, Japan

[73] Assignee: Niles Parts Co., Ltd., Japan

[21] Appl. No.: 826,126

[22] Filed: Mar. 27, 1997

[30] Foreign Application Priority Data

Mar. 28, 1996 [JP] Japan ..... 8-099011

[51] Int. Cl.[6] ..... H01H 3/42

[52] U.S. Cl. ..... 200/524

[58] Field of Search ..... 200/520–536, 200/303, 292, 5 R, 61.54, 16 F, 283, 284

[56] References Cited

U.S. PATENT DOCUMENTS

| | | | |
|---|---|---|---|
| 3,229,548 | 1/1966 | Du Temple De Rougemont et al. | 200/524 X |
| 3,821,534 | 6/1974 | Mehner et al. | 200/524 X |
| 3,898,402 | 8/1975 | Ford | 200/524 X |
| 4,382,167 | 5/1983 | Maruyama et al. | 200/303 X |
| 5,199,558 | 4/1993 | Neubauer | 200/531 |
| 5,539,169 | 7/1996 | Sekita | 200/524 |
| 5,647,478 | 7/1997 | Hirai | 200/303 |

FOREIGN PATENT DOCUMENTS

| | | |
|---|---|---|
| 13-37921 | 2/1991 | Japan . |
| 993544 | 5/1965 | United Kingdom . |
| 1 599 179 | 9/1981 | United Kingdom . |

*Primary Examiner*—J. R. Scott

*Attorney, Agent, or Firm*—Rader, Fishman & Grauer; Ronald P. Kananen

[57] ABSTRACT

A stopper structure for a switch, such as a power window switch that automatically opens and closes the window of an automobile. The stopper structure has a stopper part 2*h* on the back of a knob 2. When the knob 2 is pressed against the resistance of a spring 8, which is located between a spring guide 2*b* of the knob 2 and a first projection 1*k* inside a cylinder 1*a* of an upper case 1, the stopper part 2*h* is pressed to the head portion 2*f* of a leaf spring 2*d* that biases a lock pin 2*c* into a locking position for locking the switch assembly together. The assembled leaf spring 2*d* is then set to the designated position of a second projection 1*l* inside a cylinder 1*a* of the upper case 1. The stopper structure provides an assembly wherein the leaf spring 2*d*, which biases the lock pin 2*c* into a locking position for locking the switch assembly together, is set in the designated position with assurance using a simple structure.

6 Claims, 3 Drawing Sheets

STOPPER STRUCTURE FOR A SWITCH

BACKGROUND OF THE INVENTION

1. Field of the Invention

The present invention relates generally to a stopper structure for a switch that has a switch contact portion consisting of small switches in a case, such as a power window switch that automatically opens and closes the windows of an automobile. In particular, the present invention relates to a stopper structure for a switch that includes the assembly of a leaf spring that biases a lock pin into a locking position for locking the switch together.

2. Description of the Related Art

Conventional power window switches that automatically open and close windows of automobiles are mounted on the armrest or the internal wall of a door of the automobile. Many varieties of such power window switches have been suggested, including the one shown in Japanese Laid Open Patent Publication No. Hei 3-37921, for example. These kinds of power window switches are equipped with a switch unit that consists of a switch contact portion and a printed substrate comprised of small switches that have connecting portions. These switch components are enclosed in a case that is comprised of an upper case and a lower case that fits into the upper case.

The upper case has a supported knob that has a hanging or projecting operation lever. By attaching this operation lever of the knob to an operation axle, which is the connecting portion of the switch contact portion, the switch contact portion performs opening and closing of the power windows upon moving the knob in a horizontal direction or a vertical direction.

In the conventional power window switch, in which the operation lever of the knob is moved in the vertical direction, there is a push-lock switch that locks the window of the automobile. When the knob is assembled into the upper case, a leaf spring is initially set to a designated position in the upper case. The leaf spring functions to resistance latch the lock pin into a locking position. Then, after the leaf spring is confirmed as being definitely set into the designated locking position, the knob is assembled into the upper case.

However, when the knob is assembled into the upper case as described above, the leaf spring sometimes fails to set in the designated location in the upper case and is thus inappropriately set. In this case, it is still possible to assemble the knob into the upper case. Therefore, when the leaf spring is not securely set into an appropriate position in the upper case during the assembly process, the leaf spring falls away when the knob is operated in the vertical direction because the leaf spring exists in an unstable position. This creates a problem in the performance and reliability of the switch.

SUMMARY OF THE INVENTION

An object of the present invention is to solve the problems with the conventional switch structures described above.

More specifically, it is an object of the present invention to provide a switch that has a switch contact portion comprised of small switches in a case, such as, for example, power window switches, in which it is possible to assuredly assemble, with a simple structure, the leaf spring that biases the lock pin into a locking position, and it is also possible to produce a stopper structure for the switch in which the generation of problems for the switch is reduced to a minimum.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In accordance with the present invention, in order to solve the problems described above, a switch having a stopper structure is provided comprising an upper case; a lower case that fits in the upper case; a lock pin supported on the upper case for engaging a hanging operation lever of a knob and locking the knob to the upper case, the hanging operation lever being adapted to engage an operation member of a switch contact portion; a leaf spring for biasing the lock pin into engagement with the hanging operation lever; and a stopper structure having a second spring extending between a spring guide of the knob and a first projection in the upper case, and a stopper part that is mounted on the back side of the knob so that when the knob is pressed against the resistance of the second spring, the stopper part is pressed onto a head portion of the leaf spring and the leaf spring is thereby moved into locking engagement with a second projection in the upper case at a position in which the leaf spring biases the lock pin into engagement with the hanging or projecting operation lever.

The stopper structure of the switch preferably comprises a spacing $l_1$ between the spring guide of the knob and the first projection in the upper case which is greater than or equal to a spacing $l_2$ between the stopper part on the back of the knob and the second projection in the upper case.

In accordance with another aspect of the present invention, a switch assembly equipped with a stopper structure for locking together components of the switch assembly is provided, comprising: a case having an opening surrounded by a wall protruding from the case; a knob having a projecting portion inserted into the opening of the case, the knob being mounted to the case for reciprocating movement relative to the case, the projecting portion having a slot formed therein which extends in a direction of the movement; a lock pin inserted through a hole in the wall of the case and into locking engagement with the slot of the projecting portion to lock the knob to the case; a leaf spring for biasing the lock pin into locking engagement with the slot of the projecting portion; and a stopper structure having a second spring extending between a spring guide of the knob and a first projection of the case, and a stopper part formed on the knob for pressing the leaf spring, whereby when the knob is pressed against the resistance of the second spring, the stopper part is pressed onto a head portion of the leaf spring and the leaf spring is thereby moved into locking engagement with a second projection of the case at a position in which the leaf spring biases the lock pin into engagement with the projecting portion.

The leaf spring of the stopper structure preferably comprises a plate member having a main planar portion, a head portion extending at an approximate right angle from the planar portion at a first end of the plate, a tang extending from the planar portion at an angle toward the head portion for engaging a notch on the second projection of the case, an angled portion extending from a second end of the planar portion to facilitate movement of the leaf spring over an end of the lock pin, and a hole formed in the planar portion for receiving the lock pin in locking engagement. The lock pin has an enlarged collar portion formed thereon for abutting the leaf spring when the lock pin is in locking engagement with the hole in the leaf spring.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

Figure 1:
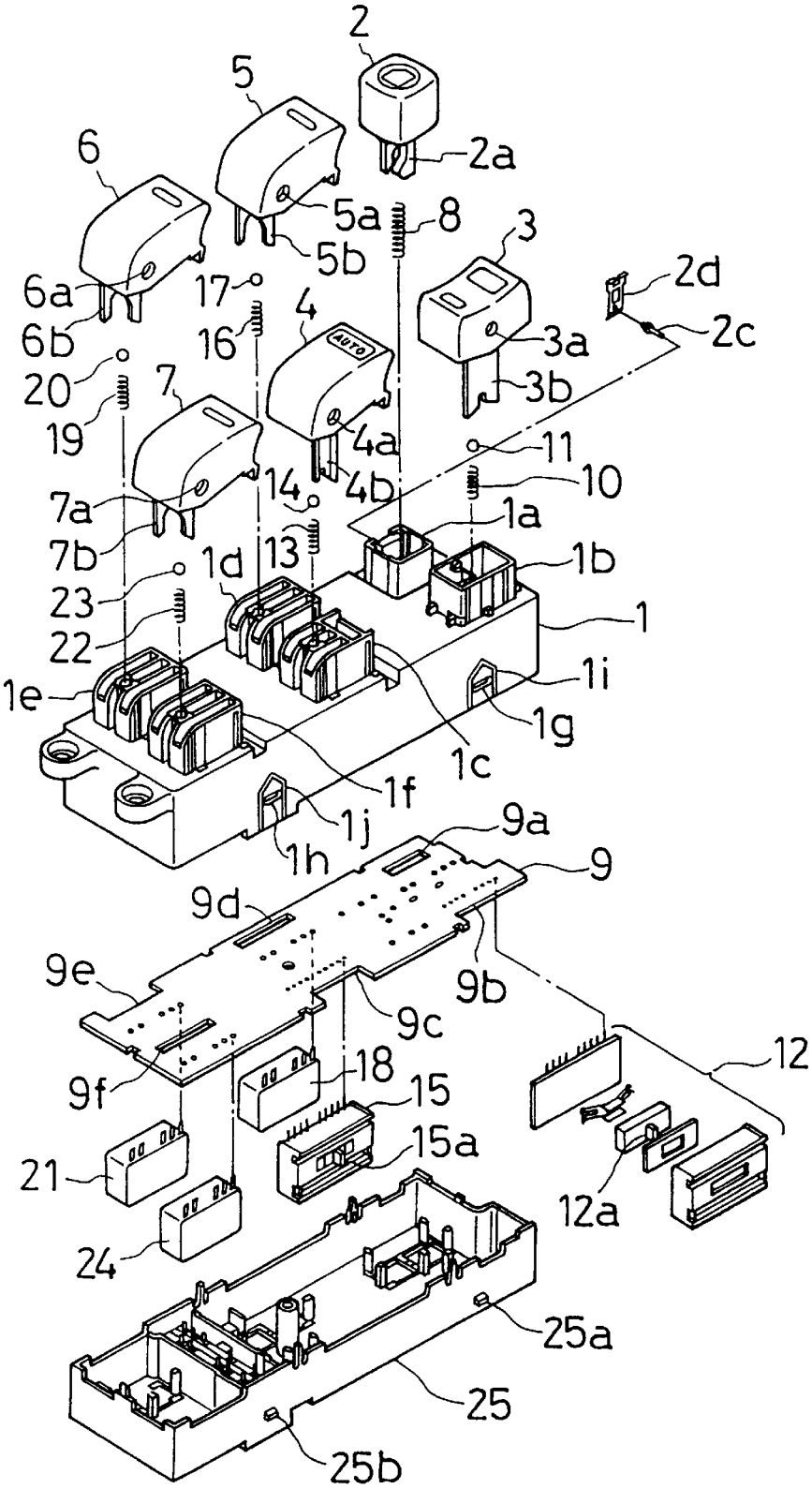
FIG. 1 is an exploded perspective view of a power window switch having a stopper structure according to a preferred embodiment of the present invention.

A preferred embodiment of a switch and stopper structure according to the present invention will now be described in detail with reference to FIGS. 1 to 3 of the drawings.

The stopper structure according to the present invention is for a power window switch, which automatically opens and closes the window of an automobile and is located in the armrest or the internal wall of a door of the automobile. The stopper structure is extremely suitable for the assembly of a leaf spring that biases the lock pin into a locking position for locking the power window switch assembly together. The simple structure of the stopper structure allows for assured assembly in the designated position.

The stopper structure of the switch according to the present invention has a stopper portion on the back of the knob which, when the knob is pressed, presses the head portion of the leaf spring so that the leaf spring can be set to the designated position in the upper case assuredly and with stability. The stopper structure thus functions to set with assurance the leaf spring, which biases the lock pin into a locking position for locking the power window switch into a designated position inside the case that stores the switch contact portion and the printed substrate of the power window switch.

The structure of the preferred embodiment of the present invention will be explained with reference to FIGS. 1 to 3 of the drawings. FIG. 1 is an exploded perspective view showing a power window switch having a stopper structure according to the present invention. FIG. 2 is an enlarged cross-sectional view of the stopper structure of the power window switch shown in FIG. 1, including a leaf spring located around the stopper structure. FIG. 3 is an enlarged perspective view that shows further details of the relationship of the structure of the leaf spring and the lock pin biased into a locking position with a slot formed in a heart-shaped cam by the leaf spring.

The switch according to the present invention comprises an upper case 1 that has knobs 2, 3, 4, 5, 6, and 7 that can be used, for example, as a power window switch located in the armrest or the internal wall of a door of an automobile. The knob 2 is the operation portion of a push-lock switch that locks the window. As shown in FIG. 2, the knob 2 has a spring 8 between a spring guide 2*b* of the knob 2 and a first projection 1*k* inside a cylinder 1*a* in the upper case 1. The cylinder 1*a* of the upper case 1 has an opening surrounded by a wall protruding from the case. The knob 2 is assembled in the upper case 1 so that the knob 2 moves freely in the vertical direction for reciprocating movement relative to the case. In addition, the knob 2 has a projecting portion in the form of a projecting operation lever 2*a* that passes through the cylinder 1*a* of the upper case 1.

The operation lever 2*a*, which moves vertically, is pushed through the cylinder 1*a* and a through hole 9*a* of a printed substrate 9 and fits into an operation axle or member (not shown) of a switch contact portion (not shown). The operation lever 2*a* has a heart-shaped cam 2*j*, as best shown in FIG. 3, which provides a slot 2*k* extending in a direction of reciprocating movement of the knob 2. One edge of a lock pin 2*c*, which locks the switch, is pushed into this slot 2*k* formed in the operation lever 2*a*, as shown in FIGS. 2 and 3, and the other edge is inserted into a hole 2*e* in the lower portion of a leaf spring 2*d* that biases the lock pin 2*c* into a locking position. As shown in FIG. 3, the leaf spring 2*d* is formed in a plate shape and a head portion 2*f* is bent in a right angle from a main planar portion of the leaf spring 2*d*. The upper center portion of the leaf spring 2*d* has a tang 2*g* that is formed by cutting and slightly bending the cut area toward the head portion 2*f* in the same direction that the head portion 2*f* is bent.

A stopper part 2*h* is attached on the back of the knob 2. When the knob 2 is pressed, the stopper part 2*h* is pressed onto the head portion 2*f* of the leaf spring 2*d* , and the head portion 2*f* is attached from the pressure to the upper edge surface of a second projection 1*l* inside the cylinder 1*a* of the upper case 1. At the same time, the tang 2*g* of the leaf spring 2*d* is hooked to a notch 1*m* located on the side of the second projection 1*l* so that the leaf spring 2*d* is assembled with assurance in the designated position of the second projection 1*l*. In this position, the leaf spring 2*d* is placed in locking engagement with the second projection 1*l* at a position in which the leaf spring 2*d* biases the lock pin into engagement with the slot 2*k* of the heart-shaped cam 2*j* formed in the projecting operation lever.

Figure 2:
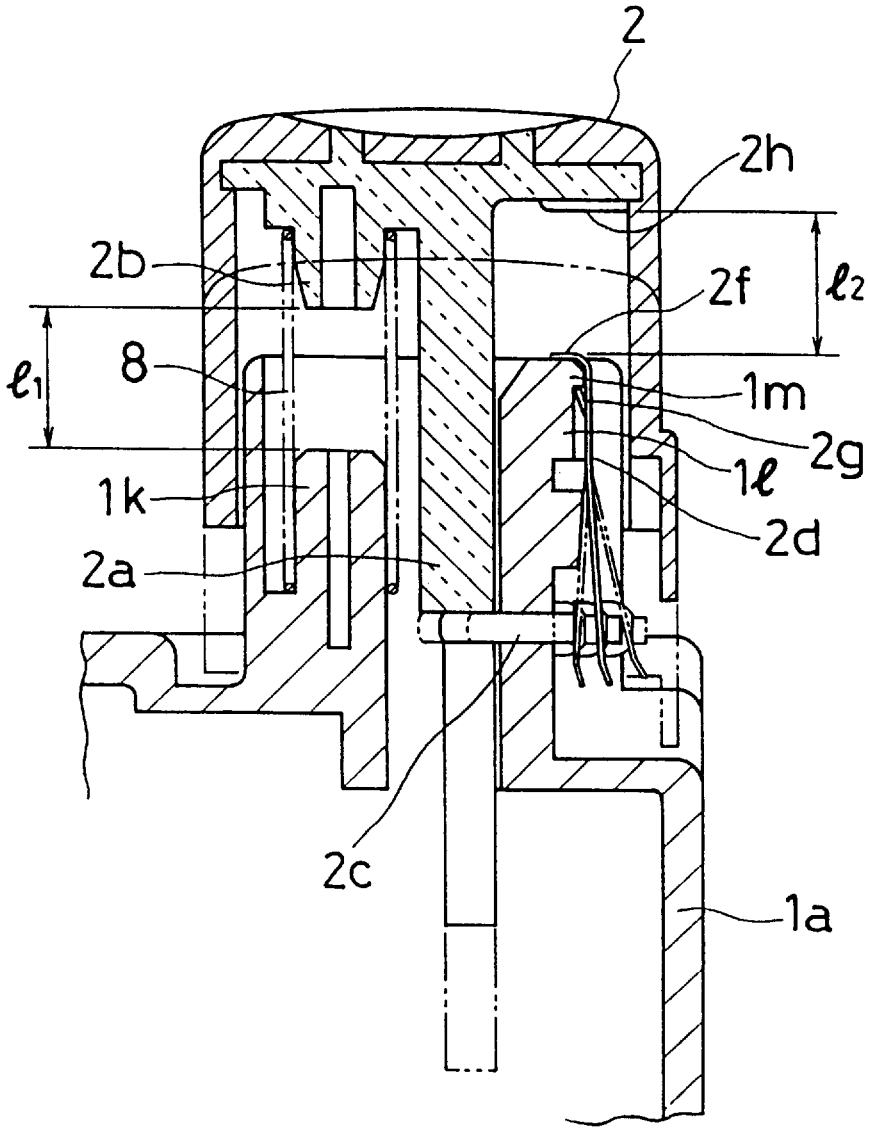
FIG. 2 is an enlarged cross-sectional view of the stopper structure of the power window switch shown in FIG. 1, including a leaf spring located around the stopper structure.

In addition, as shown in FIG. 2, when the space between the spring guide 2*b* of the knob 2 and the first projection 1*k* inside the cylinder 1*a* of the upper case 1 is referred to as $l_1$, and the space between the stopper part 2*h* on the back of the knob 2 and the second projection 1*l* inside the cylinder 1*a* of the upper case 1 is referred to as $l_2$, the structure is defined by the relation $l_1 \geqq l_2$.

Figure 3:
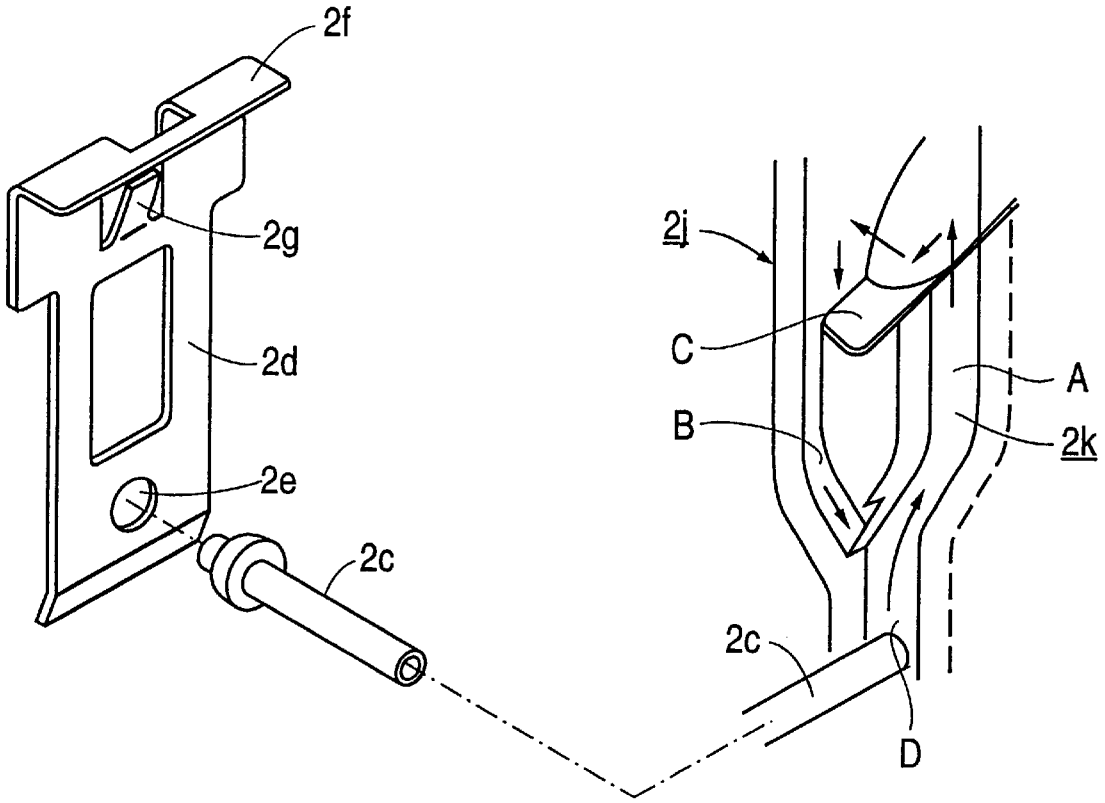
FIG. 3 is an enlarged perspective view that shows further details of the relationship of the structure of the leaf spring, a lock pin and a heart-shaped cam.

As shown in FIG. 3, the leaf spring 2*d* of the stopper structure comprises a plate member having a main planar portion, a head portion 2*f* extending at a right angle from the planar portion at a first end of the plate, a tang 2*g* extending from the planar portion at an angle toward the head portion 2*f* for engaging a notch 1*m* on the second projection 1*l* of the switch case, an angled portion extending from a second end of the planar portion to facilitate movement of the leaf spring 2*d* over an end of the lock pin 2*c*, and a hole 2*e* formed in the planar portion of the leaf spring 2*d* for receiving the lock pin 2*c* in locking engagement. The lock pin 2*c* has an enlarged collar portion formed thereon for abutting the leaf spring 2*d* when the lock pin 2*c* is in locking engagement with the hole 2*e* in the leaf spring 2*d*.

The heart-shaped cam 2*j* formed in the operation lever 2*b* has a slot 2*k* formed therein. The slot 2*k* has a locking path portion A and an unlocking path portion B. The locking path A and unlocking path B are both contoured to form the conventional "heart-shape" of the heart-shaped cam 2*j*, as seen in FIG. 3. A supporting wall C is formed between the locking path A and the unlocking path B for placing the lock pin 2*c* in a locking position.

The knob 3 is an operational part of a seesaw switch that locks a door of the vehicle. The knob 3 is assembled onto the upper case 1 by fitting a hook (not shown) inside a hole 3*a* into a supporting axle or member (not shown) inside a cylinder 1*b* of the upper case 1, so that the knob 3 moves freely. Inside the knob 3, there is a control gutter (not shown) into which a steel ball 11, which is attached to a spring 10, is pressed. The control gutter allows the knob 3 to automatically go back to the off position. The knob 3 contains a Y-shaped operation lever 3*b*. The lower edge of the operation lever 3*b* passes through the cylinder 1*b* and a notch 9*b* of the printed substrate 9 and is fitted into an operation axle or member 12*a* of a switch contact portion 12.

The knob 4 is an operational part of a two-step seesaw switch that opens and closes the window for the driver seat. The knob 4 is assembled onto the upper case 1 by fitting a hook (not shown) inside a hole 4*a* to a supporting axle (not shown) inside a cylinder 1*c* of the upper case 1, so that the knob 4 moves freely. The knob 4 moves a window up and down during the operation time of the first-step operation. With the second-step operation, the knob 4 automatically moves the window up and down. Inside the knob 4, there is a control gutter (not shown) into which a steel ball 14, which is attached to a spring 13, is pressed. The control gutter allows the knob 4 to automatically go back to the off position. The knob 4 contains a Y-shaped operation lever 4*b*. The lower edge of the operation lever 4*b* passes through a cylinder 1*c* and a notch 9*c* of the printed substrate 9 and fits into an operation axle or member 15*a* of a switch contact portion 15.

The knob 5 is an operational part of an automatic-return seesaw switch that opens and closes the window for the passenger seat. It is assembled onto upper case 1 by fitting a hook (not shown) inside a hole 5*a* to the supporting axle or member (not shown) inside a cylinder 1*d* of the upper case 1, so that it moves freely. Inside the knob 5, there is a control gutter (not shown) into which a steel ball 17, which is attached to a spring 16, is pressed. This control gutter allows the knob 5 to automatically go back to the off position. The knob 5 contains a Y-shaped operation lever 5*b*. The lower edge of the lever 5*b* passes through the cylinder 1*d* and a through hole 9*d* of the printed substrate 9 and fits into the operation axle or member (not shown) of the switch contact portion 18.

The knob 6 is an operational part of an automatic-return seesaw switch that opens and closes the window for the right rear passenger seat. The knob 6 is assembled onto the upper case 1 by fitting a hook (not shown) inside a hole 6*a* to the supporting axle or member (not shown) inside a cylinder 1*e* of the upper case 1, so that it moves freely. Inside the knob 6, there is a control gutter (not shown) into which a steel ball 20, which is attached to a spring 19, is pressed. This control gutter allows the knob 6 to automatically go back to the off position. The knob 6 contains a Y-shaped operation lever 6*b*. The lower edge of the operation lever 6*b* passes through the cylinder 1*e* and a notch 9*e* of the printed substrate 9 and fits into the operation axle or member (not shown) of a switch contact portion 21.

The knob 7 is an operational part of an automatic-return seesaw switch that opens and closes the window for the left rear passenger seat. The knob 7 is assembled onto the upper case 1 by fitting a hook (not shown) inside a hole 7*a* to the supporting axle or member (not shown) inside a cylinder 1*f* of the upper case 1, so that the knob 7 moves freely. Inside the knob 7, there is a control gutter (not shown) into which a steel ball 23, which is attached to a spring 22, is pressed. This control gutter allows the knob 7 to automatically go back to the off position. The knob 7 contains a Y-shaped operation lever 7*b*. The lower edge of the operation lever 7*b* passes through the cylinder 1*f* and a through hole 9*f* of the printed substrate 9 and fits into the operation axle or member (not shown) of a switch contact portion 24.

A plurality of holes 1*g* and 1*h* are formed on the side of the upper case 1. A corresponding plurality of projections 25*a* and 25*b* are formed on the side of lower case 25. The case is assembled by fitting the projected portions 25*a* and 25*b* of the lower case 25 into the holes 1*g* and 1*h* of the upper case 1, respectively. The upper case 1 and lower case 25 are both made by a molding process for plastic. Therefore, the upper case 1 and the lower case 25 are firmly fitted together with pressure resistance.

Ribs 1*i* and 1*j* are formed on the side of the upper case 1 surrounding the holes 1*g* and 1*h* at a desired height (for example, around 0.3 mm). Therefore, when liquid from a water spill, rain, or the like flows over the surface of the power window switch as described above, the liquid flows from the upper portion of the upper case 1 along the side, and is directed to flow along the circumference of the ribs 1*i* and 1*j* in the downward direction. Finally, the liquid forms a dripping water drop and drains in the downward direction from the upper case 1.

The power window switch for automatically opening and closing the windows of an automobile according to the present invention is characterized by a stopper structure having a stopper part 2*h*, which is placed on the back side of the knob 2. The knob 2 is the operation portion of the push-lock switch that locks the action of the power window switch.

In the case that the stopper structure of the switch of the present invention is applied to a power window switch that automatically opens and closes the windows of an automobile, the knob 2 is assembled to the upper case 1 with the spring 8 positioned between the spring guide 2*b* of the knob 2 and the first projection 1*k* inside the cylinder 1*a* of the upper case 1 so that the knob 2 moves freely in the vertical direction. One edge of the lock pin 2*c* of the switch is pushed into the slot 2*k* of the heart-shaped cam 2*j* formed on the operation lever 2*a* of the knob 2, and the other edge of the lock pin 2*c* which is connected to the cylinder 1*a* of upper case 1 by a hole 1*n*, is inserted into the hole 2*e* (see FIG. 3) in the lower portion of the leaf spring 2*d*, which biases the lock pin 2*c* into a locking position.

In operation, the knob 2, which is the operation portion of a push-lock switch for locking the action of the power window switch, is pushed downward from the position indicated by a solid line in FIG. 2 to the position indicated by a dotted line against the resistance power of the spring 8. When the knob 2 is pushed downward, the stopper part 2*h*, which is on the back of the knob 2, is pressed to the head portion 2*f* of the leaf spring 2*d* and the head portion 2*f* is attached by pressure to the upper edge surface of the second projection 1*l* inside the cylinder 1*a* of the upper case 1. At the same time, the tang 2*g* of the leaf spring 2*d* is hooked to the notch 1*m* located on the side of the second projection 1*l*. As a result, the leaf spring 2*d* can be assembled with assurance at the designated position of the second projection 1*l* inside the cylinder 1*a* of the upper case 1.

As shown in FIG. 2, the space between the spring guide 2*b* of the knob 2 and the first projection 1*k* inside the cylinder 1*a* of the upper case 1 is designated as $l_1$, and the space between the stopper part 2*h* on the back of the knob 2 and the second projection 1*l* inside the cylinder 1*a* of the upper case 1 is designated as $l_2$. The relative distances of the spaces $l_1$ and $l_2$ fit the relation $l_1 \geqq l_2$. Thus, when the leaf spring 2*d* is assembled, even if sometimes the leaf spring 2*d* is set in an inappropriate position inside the cylinder 1*a* of the upper case 1, the stopper part 2*h* can set the leaf spring 2*d* from the inappropriate set position to the designated set position smoothly and assuredly just by depressing the knob 2 once.

Referring to FIGS. 2 and 3, before the knob 2 is pushed downward against the force of the spring 8, one edge of the lock pin 2*c*, which is engaged with the leaf spring 2*d* and cylinder 1*a*, is positioned generally at a starting position D within the slot 2*k*. As the knob 2 is pushed downward, the operation lever 2*b* with the heart-shaped cam 2*j* is moved downward and the lock pin 2*c* moves along the locking path A of the slot 2*k*. The action of the stopper part 2*h* against the leaf spring 2*d* serves to ensure that the lock pin 2*c* is biased into the slot 2*k*. The lock pin 2*c* comes to rest on the supporting wall C, whereby the force of the spring 8 and the lock pin 2*c* cooperate to lock the knob 2 into a locking position wherein the operation lever 2*a* is engaged with the operation member (not shown) of a switch contact portion (not shown), locking the action of the power window switch.

To release the knob 2, knob 2 is pushed downward again, and the spring 8 forces the lock pin 2*c* out of engagement with the supporting wall C. The lock pin 2*c* is then directed along the unlocking path B back to the starting position D.

As described above, with the stopper structure according to the present invention, a switch is provided that has an upper case, a lower case that fits in the upper case, a lock pin supported on the uppercase for engaging a hanging operation lever of the knob and locking the switch assembly together, a knob that has a leaf spring for biasing the lock pin into engagement with the hanging operation lever, and a switch contact portion that has an operation member that attaches to the operation lever of the knob. The present invention is characterized by the stopper structure for the switch that has a second spring between a spring guide of the knob and a first projection in the upper case, and a stopper part that is mounted on the back side of the knob so that when the knob is pressed against the resistance of the second spring, the stopper part is pressed onto the head portion of the leaf spring and the leaf spring is fit into the designated position in locking engagement with the second projection in the upper case. With the stopper structure of the present invention it is possible to assemble the leaf spring using a simple structure to the designated position assuredly. The present invention has the superior effect that it can reduce the generation of problems with switches to a minimum.

The present invention is also characterized by the stopper structure described above having a structure wherein a space $l_1$ between the spring guide of the knob and the first projection 1*k* of the upper case is greater than or equal to the space $l_2$ between the stopper part on the back of the knob and the second projection 1*l* of the upper case. Thus, when the leaf spring is assembled, the stopper part can set the leaf spring from an inappropriately set position to the designated set position smoothly and assuredly just by pressing the knob once.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. A switch knob assembly comprising:

an upper case;

a lower case that fits in the upper case;

a knob having a projection operation lever that moves in a reciprocating manner into and out of engagement with an operation member of a switch contact portion;

a lock pin connected to the upper case, wherein said lock pin is engagable with the operation lever of the knob to lock the knob to the upper case;

a leaf spring, said lock pin being engaged with said leaf spring; and a stopper structure having a second spring between a spring guide of the knob and a first projection in the upper case, and a stopper part that is mounted on the back side of the knob so that when the knob is pressed against the resistance of the second spring, the stopper part is pressed onto a head portion of the leaf spring thereby moving the leaf spring into locking engagement with a second projection in the upper case at a position in which the leaf spring biases said lock pin into engagement with said projection operation lever to lock the knob to the upper case.

2. The switch according to claim 1, wherein a spacing $l_1$ between the spring guide of said knob and the first projection in said upper case is greater than or equal to a spacing $l_2$ between said stopper part on the back of said knob and the second projection in said upper case.

3. A switch knob assembly equipped with a stopper structure for locking together components of the switch knob assembly, comprising:

a case having an opening substantially surrounded by a wall protruding from said case;

a knob having a projecting portion inserted into said opening of said case, said knob being mounted to said case for reciprocating movement relative to said case, said projecting portion having a slot formed therein which extends in a direction of said reciprocating movement;

a lock pin retained within a hole in said wall of said case, wherein said lock pin is engagable with said slot of said projecting portion to lock said knob to said case;

a leaf spring, wherein said lock pin is engaged with said leaf spring so as to bias said lock pin into engagement with said slot of said projecting portion; and a stopper structure having a second spring extending between a spring guide of the knob and a first projection of the case, and a stopper part formed on the knob for pressing said leaf spring, whereby when the knob is pressed against the resistance of the second spring, the stopper part is pressed onto a head portion of the leaf spring and the leaf spring is thereby moved into locking engagement with a second projection of the case at a position in which the leaf spring biases said lock pin into engagement with said slot to direct said lock pin into a locking position within said slot thereby locking said knob to said case.

4. The switch according to claim 3, wherein a spacing $l_1$ between the spring guide of said knob and the first projection of said case is greater than or equal to a spacing $l_2$ between said stopper part on the knob and the second projection of said case.

5. The switch according to claim 3, wherein said leaf spring comprises a plate having a main planar portion, said head portion extending at an approximate right angle form said planar portion at a first end of said plate, a tang extending from said planar portion at an angle toward said head portion for engaging a notch on said second projection of said case, an angled portion extending form a second end of said planar portion to facilitate movement of said leaf spring over an end of said lock pin, and a hole formed in said planar portion wherein said lock pin engages said hole to lock said lock pin to said leaf spring in a locking engagement.

6. The switch according to claim 5, wherein said lock pin has an enlarged collar portion formed thereon for abutting said leaf spring when said lock pin is in locking engagement with said hole in said leaf spring.

* * * * *